US010524986B2

(12) United States Patent
Meritt

(10) Patent No.: US 10,524,986 B2
(45) Date of Patent: Jan. 7, 2020

(54) PILL ORGANIZER

(71) Applicant: JOBAR INTERNATIONAL, Inc., Carson, CA (US)

(72) Inventor: Matthew Meritt, Long Beach, CA (US)

(73) Assignee: JOBAR INTERNATIONAL, INC., Carson, CA (US)

( * ) Notice: Subject to any disclaimer, the term of this patent is extended or adjusted under 35 U.S.C. 154(b) by 0 days.

(21) Appl. No.: 15/619,106

(22) Filed: Jun. 9, 2017

(65) Prior Publication Data

US 2018/0353387 A1 Dec. 13, 2018

(51) Int. Cl.

| | |
|---|---|
| ***B65D 85/42*** | (2006.01) |
| ***B65D 83/04*** | (2006.01) |
| ***A61J 7/04*** | (2006.01) |
| ***A61J 7/00*** | (2006.01) |
| *A45C 11/24* | (2006.01) |

(52) U.S. Cl.

CPC ..... *A61J 7/04* (2013.01); *A61J 7/0007* (2013.01); *A61J 7/0069* (2013.01); *B65D 83/0445* (2013.01); *A45C 11/24* (2013.01)

(58) Field of Classification Search

CPC A61J 7/04; A61J 7/0007; A61J 7/0069; A61J 7/0084; A61J 1/03; B65D 83/0445; B65D 83/04; B65D 85/42; A45C 11/24

USPC ..... 206/528–540, 6.1, 223, 234; 30/495, 30/121.5, 124; 225/103, 104; 221/30; 222/80

See application file for complete search history.

(56) References Cited

U.S. PATENT DOCUMENTS

| | | | | |
|---|---|---|---|---|
| 5,267,650 | A * | 12/1993 | Gilbilisco | A61J 1/03 206/534 |
| 6,158,578 | A * | 12/2000 | Greiner | A47F 5/10 206/6.1 |
| 8,146,627 | B2 * | 4/2012 | Mazur | A61J 1/03 141/240 |
| 2008/0109510 | A1 * | 5/2008 | Gerlt | A61J 7/04 709/201 |
| 2015/0209226 | A1 * | 7/2015 | Priebe | B65D 43/22 206/538 |
| 2016/0158109 | A1 * | 6/2016 | Nova | G06F 19/3462 206/534 |
| 2017/0273870 | A1 * | 9/2017 | Radomil | A61J 1/1412 |
| 2017/0354562 | A1 * | 12/2017 | Gipson | A61G 12/001 |

OTHER PUBLICATIONS

Round Pill Box, http://www.pillcrusher.com/store/pc/Round-Pill-Box-p67.htm, 1 page.

Vita Carry, Handheld Power Pill Grinder, http://www.medicalproductsdirect.com/vicahapopigr.html, 1 page.

(Continued)

*Primary Examiner* — Rafael A Ortiz

(74) *Attorney, Agent, or Firm* — Lewis Roca Rothgerber Christie LLP

(57) ABSTRACT

A pill organizer includes a housing including a plurality of internal compartments and an external compartment, at least one pill holder for being received into one of the plurality of compartments, the at least one pill holder including a plurality of chambers, and a plurality of spaced apart ribs extending from an upper surface of the housing.

20 Claims, 8 Drawing Sheets

(56) References Cited

OTHER PUBLICATIONS

SwirlColor, 2x Travel 7 Compartment Pill Box Medicine Tablet Holder Organizer Dispenser Case, https://www.amazon.co.uk/SwirlColor-Compartment-Medicine-Organizer-Dispenser/dp/B01A6EAPWC, 1 page.
Asobu, Combine Daily Pill Box Organizer with Water Bottle, https://www.amazon.com/Asobu-Combine-Daily-Organizer-Bottle/dp/B00V8SKDHS, 1 page.
Survive Vitamins, 7 day AM PM Pill Organizer, https://www.amazon.com/Survive-Vitamins-organizer-plastic-translucent/dp/B01ADUJS8Q, 1 page.
VitaCarry, 7 Day Push Button Pill Organizer with Safety Lock Weekly Pill Box, http://www.ebay.in/geb/ImportHubViewItem?itemid=131771888224, 1 page.
Apex, Pocket Med Pack with 7 Day Tray, http://www.qroupmedshop.com/pocket-med-pack-with-7-day-tray.html?fee=15&fep=601&utm_source=Google+Shopping&utm_medium=paid+search&utm_campaign=+GroupMedShop+-+Google+Shopping&gclid=COWs4uausdQCFU9sfgodZMUPjQ, 1 page
7-Day AM/PM Detach N' Go™, Pill Organizer, http://www.carex.com/item/DGF00200/7-Day-AM-PM-Detach-N-Go-8482-Pill-Organizer/#.WTrktdJ1qUk, 1 page.
Umbra, Cylindra Spice Rack, https://www.amazon.com/Umbra-Cylindra-Spice-Rack-Black/dp/B00EV66PU8, 1 page.
Sabi, Pill Dispenser, http://www.zdnet.com/article/start-up-designs-hip-health-gear-for-aging-baby-boomers/, 1 page.
iHerb, Day & Night Pill Organizer, http://pusabase.com/iherb-reviews/review-iherb-pill-organizer/, 1 page.
Med-Q, Pill Dispenser, http://www.prweb.com/releases/2012/10/prweb10020970.htm, 1 page.
7 days/One week Round Plastic Pill Box, https://www.alibaba.com/product-detail/Hot-selling-7-days-One-week_60281493339.html, 1 page.
Weekly Pill Box Organizer, Unknown source, 1 page.
PillRite Medication and Supplement Pillbox Organizer, https://www.amazon.com/PillRite-Medication-Supplement-Pillbox-Organizer/dp/B00GOLMG7O, 1 page.
6-Section Pill Organizer, https://www.mileskimball.com/buy-6-section-pill-organizer-311722, 1 page.
Sabi, Holster Clip-On Pill Organizer, https://jet.com/product/detail/d723a8686e5c4b6691072b0abf8d9aa0?jcmp=pla:ggl:NJ_cons_Gen_Health_Beauty_a3:Health_Beauty_Medical_Supplies_Equipment_Pill_Cases_Splitters_a3:na:PLA_786070203_37816627381_pla-293019479921:na:na:na:2&code=PLA15&pid=kenshoo_int&c=786070203&is_retargeting=true&clickid=e8bc4a19-0de2-415-e-a5a2-ad79d4759b57&gclid=COSev62msdQCFZFfgodJplNnQ, 1 page.
Pill cutter, https://www.thingiverse.com/thing:253940/apps/customize/, published Feb. 20, 2014, 1 page.
eNNOVEA life, Pill Planner/Sorting Tray, http://14daypillplanner.com/index.php/instructions/step-by-step#, 2 pages.

* cited by examiner

PILL ORGANIZER

BACKGROUND OF THE INVENTION

Pill organizers are used by people that have to take multiple pills on a daily basis to keep their pills for each day organized. Pill organizers that allow for sorting, cutting and/or stacking of multiple organizers are desired.

SUMMARY

In an example embodiment a pill organizer includes a housing including a plurality of internal compartments and an external compartment, at least one pill holder for being received into one of the plurality of compartments, the at least one pill holder including a plurality of chambers, and a rib or a plurality of spaced apart ribs extending from an upper surface of the housing, the rib or plurality of ribs being one less than the plurality of chambers. In a further example embodiment, the pill organizer also includes a pill cutter receivable in the external compartment. In an example embodiment, the pill cutter includes one of a projection or depression and the external compartment includes the other of a projection of depression, and the projection is received in the depression for mating the pill cutter to the external compartment. In another example embodiment, the pill cutter is capable of cutting pills while mated to the external compartment. In yet another example embodiment, one of the at least one pill holder is receivable in the external compartment. In a further example embodiment, the ribs extend to a first end of the housing but not to a second end opposite the first end. In yet a further example embodiment, the pill organizer further includes a lip extending from the upper surface to receive at least a foot extending from a lower surface of another pill organizer for stacking the another pill organizer on the pill organizer.

In another example embodiment a pill organizer includes a housing including a plurality of internal compartments and an external compartment, at least one pill holder for being received into one of the plurality of compartments, the at least one pill holder including at least one chamber, and a pill cutter received in the external compartment. In yet another example embodiment, the pill cutter includes one of a projection or depression and the external compartment includes the other of a projection of depression, and the projection is received in the depression for mating the pill cutter to the external compartment. In a further example embodiment the pill cutter is capable of cutting pills while mated to the external compartment.

In one example embodiment, one of the at least one pill holder is receivable in the external compartment when the pill cutter is not received in the external compartment. In a further example embodiment, the pill organizer also includes a lip extending from the upper surface to receive at least a foot extending from a lower surface of another pill organizer for stacking the another pill organizer on the pill organizer.

In another example embodiment, a pill organizer includes a housing including a plurality of internal compartments and an external compartment, at least one pill holder for being received into one of the plurality of compartments, the at least one pill holder including at least one chamber, and at least one channel formed on an upper surface of the housing. In yet another example embodiment, the at least one chamber is a plurality of chambers and the at least one channel is a plurality of channels and the plurality of channels is equal to the plurality of chambers. In one example embodiment, the pill organizer also includes a pill cutter receivable in the external compartment. In a further example embodiment, the pill cutter includes one of a projection or depression and the external compartment includes the other of a projection of depression, and the projection is received in the depression for mating the pill cutter to the external compartment. In one example embodiment, the pill cutter is capable of cutting pills while mated to the external compartment. In another example embodiment, one of the at least one pill holder is receivable in the external compartment. In yet another example embodiment, the pill organizer further includes a lip extending from the upper surface to receive at least a foot extending from a lower surface of another pill organizer for stacking the another pill organizer on the pill organizer.

In yet another example embodiment, a pill organizer housing includes a plurality of internal compartments each for receiving a pill holder, and an external compartment for receiving a pill holder. In one example embodiment, the housing includes an outer surface including a plurality of channels leading to the external compartment.

DETAILED DESCRIPTION

Figure 1:
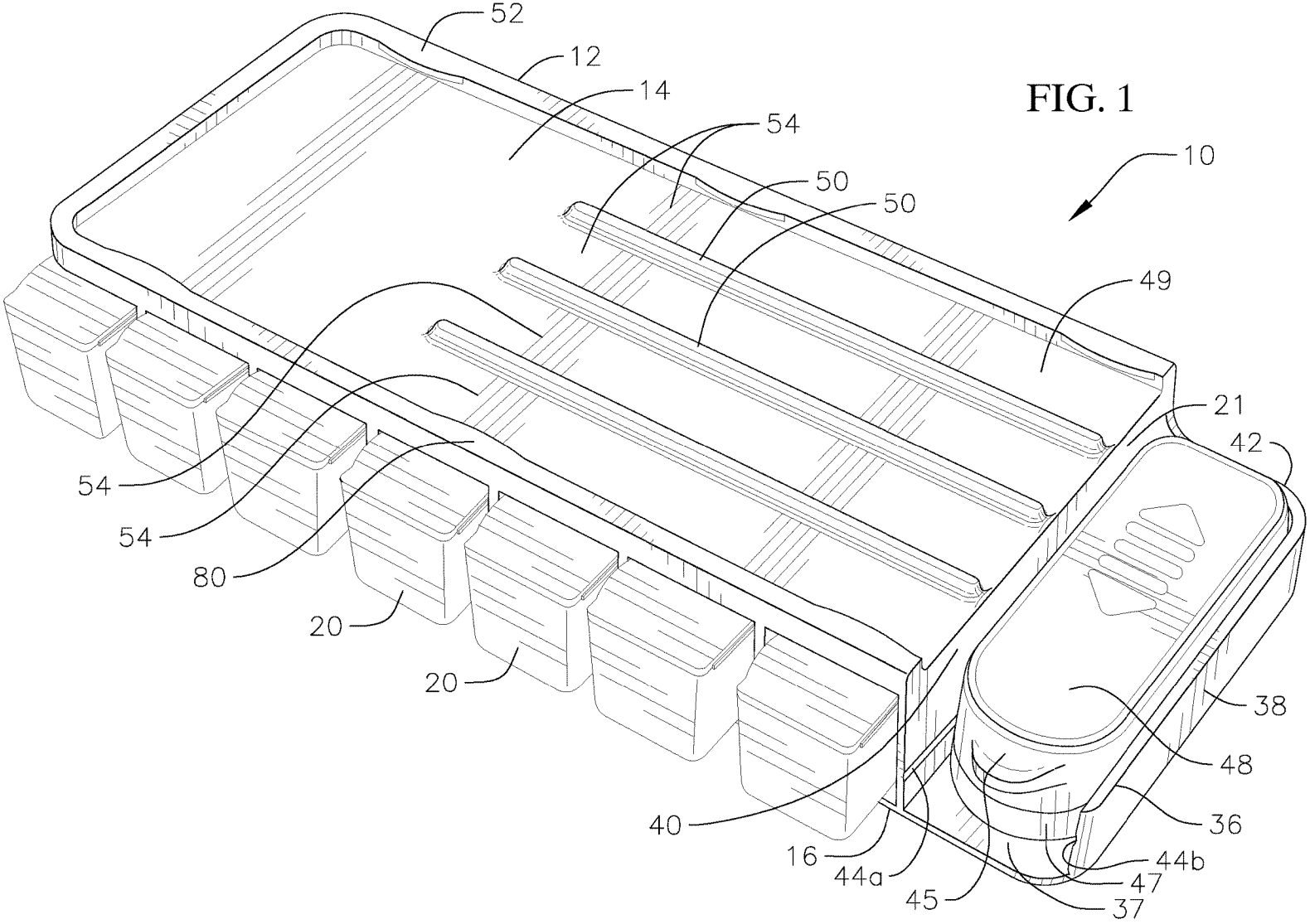
FIG. 1 is a perspective view of an example embodiment pill organizer.
Figure 2:
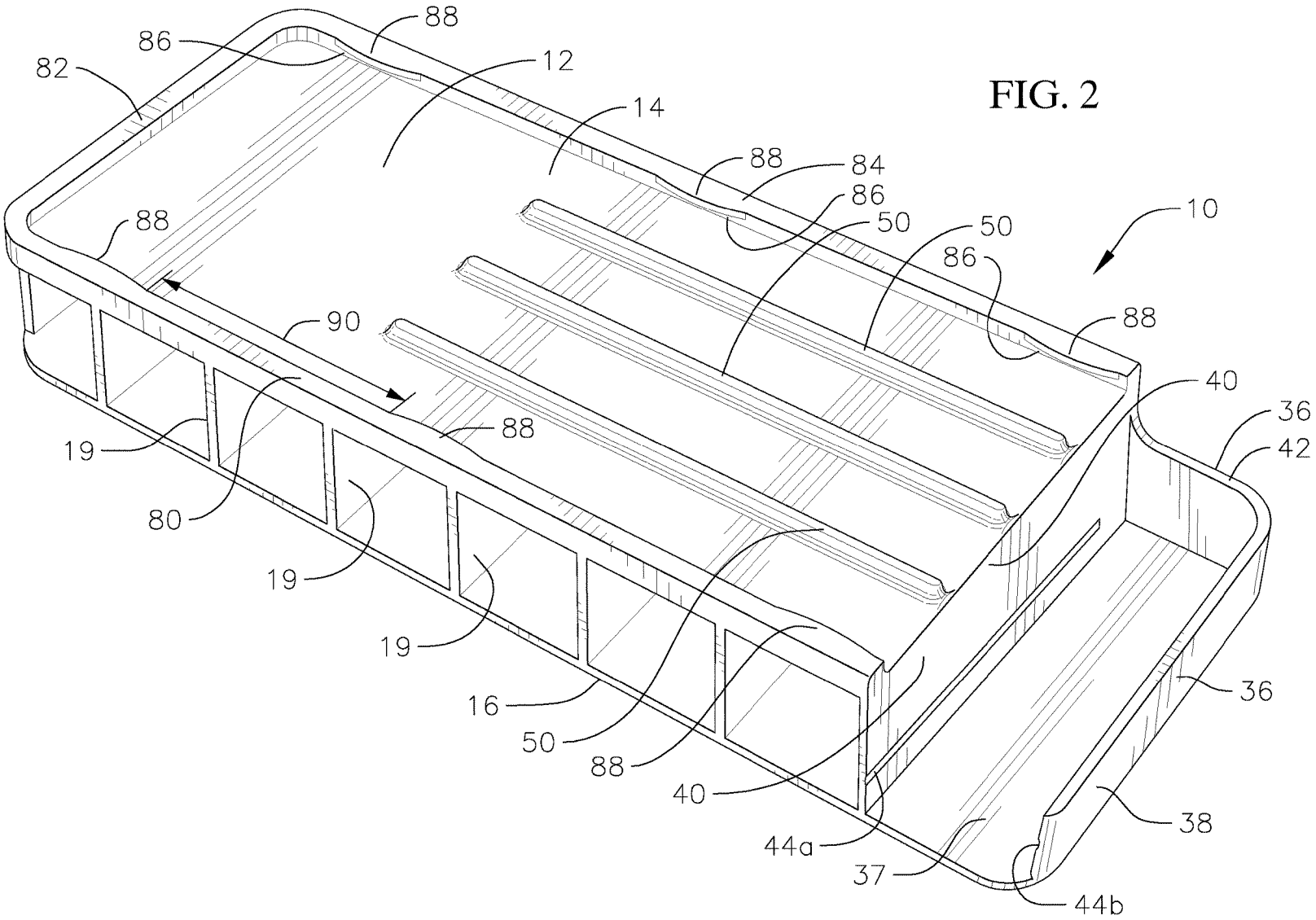
FIG. 2 is an example embodiment of the housing of the pill organizer depicted in FIG. 1.
Figure 3:
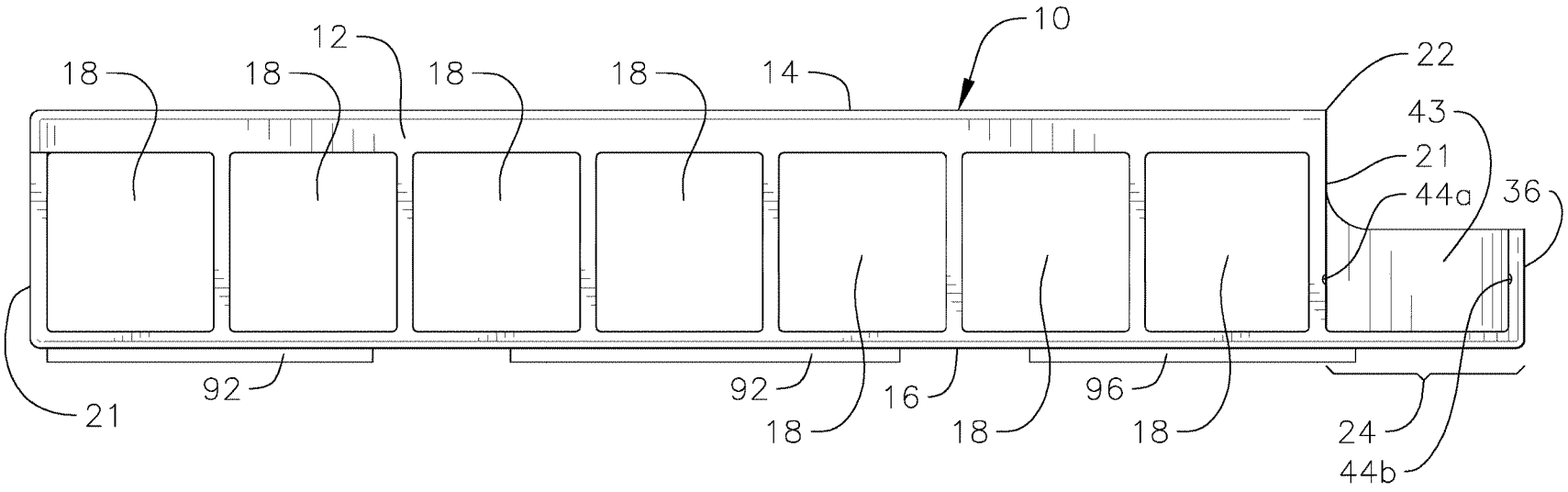
FIG. 3 is a front end view of the pill organizer housing depicted in FIG. 2.

A pill organizer 10 according to an example embodiment, includes a housing 12 or case which in an example embodiment has an upper wall 14 opposite and spaced apart from a lower wall 16, as for example shown in FIGS. 1, 2 and 3. Multiple compartments 18 are formed between the upper and lower walls. In an example embodiment, seven compartments 18 are formed each for receiving a pill holder 20 for each day of the week. In an example embodiment, compartments are defined by compartment walls 19 extending between the upper and lower walls. A peripheral wall 21 extends between and bridges the upper and lower walls defining the entire housing except at the portion of the housing where the compartments are formed. In the shown example embodiment, the housing is rectangular and the peripheral wall extends along the three sides of the rectangular housing that do not form an entry for the compartments. In an example embodiment, the lower wall 16 extends beyond one end 22 of the upper wall 14 defining an extension 24.

Figure 4:
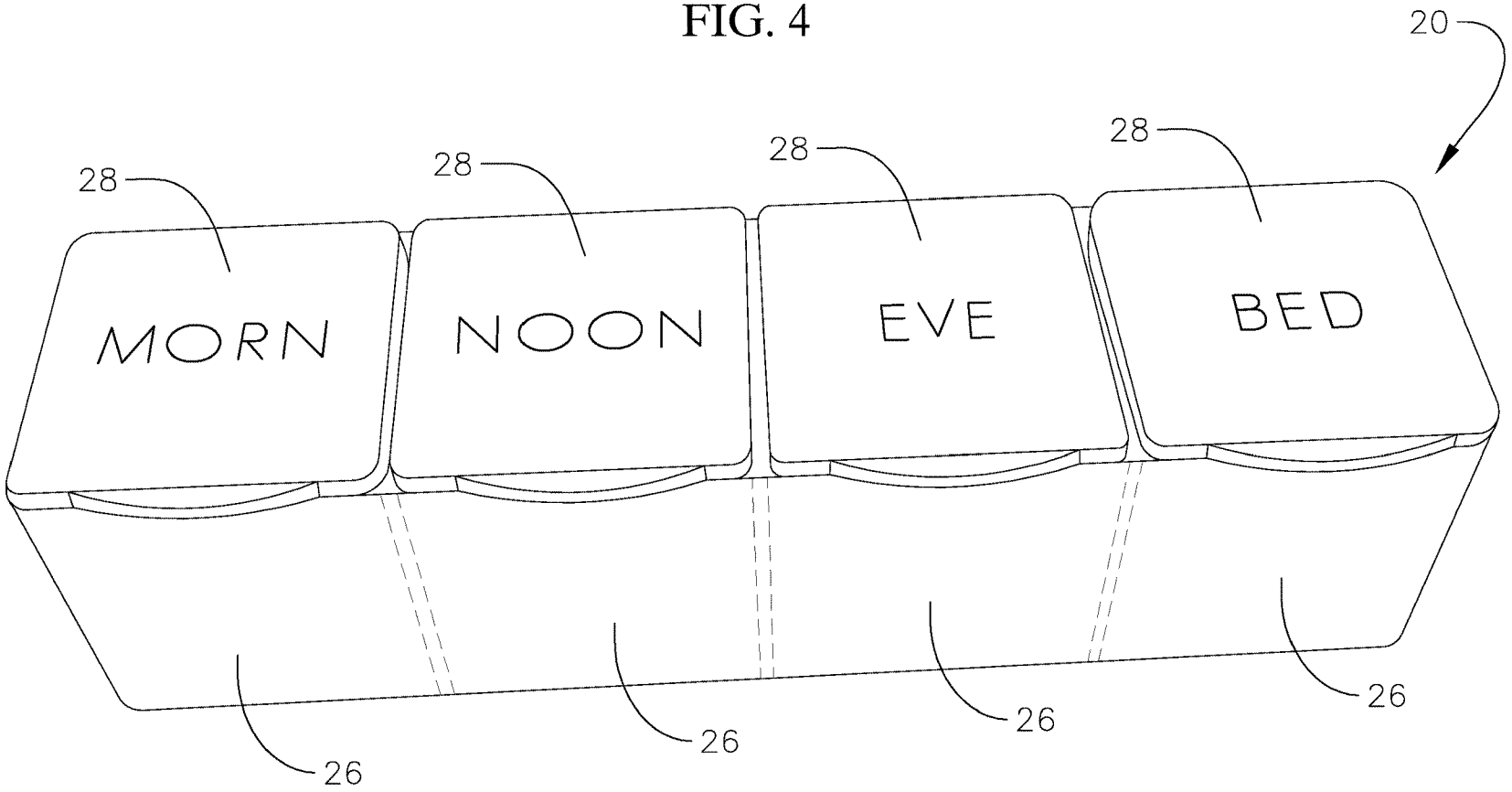
FIG. 4 is a perspective view of an example embodiment pill holder used with the example embodiment pill organizer depicted in FIG. 1.
Figure 5:
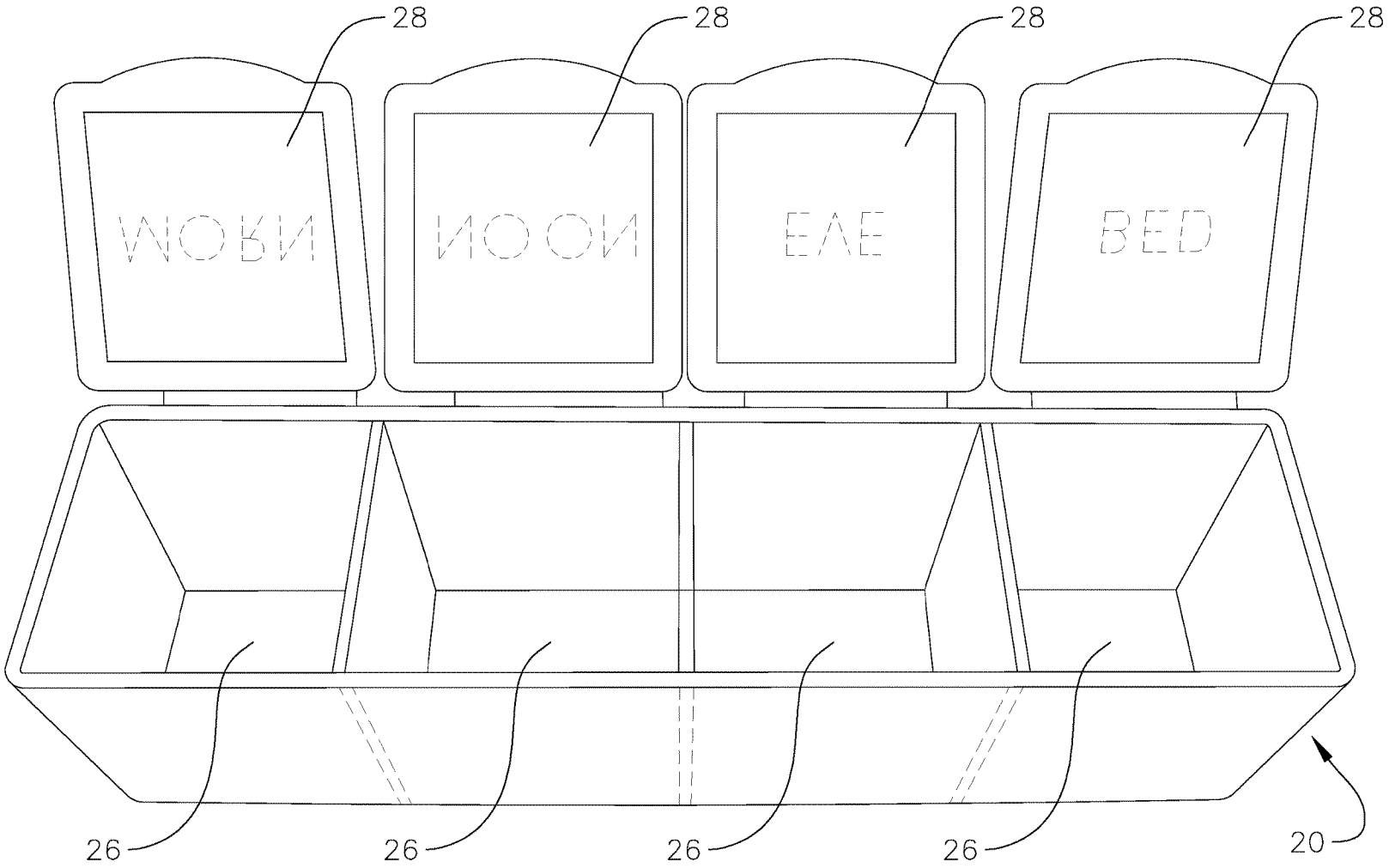
FIG. 5 is a perspective view of the example embodiment pill holder shown in FIG. 4 with the lids in an open position.
Figure 6:
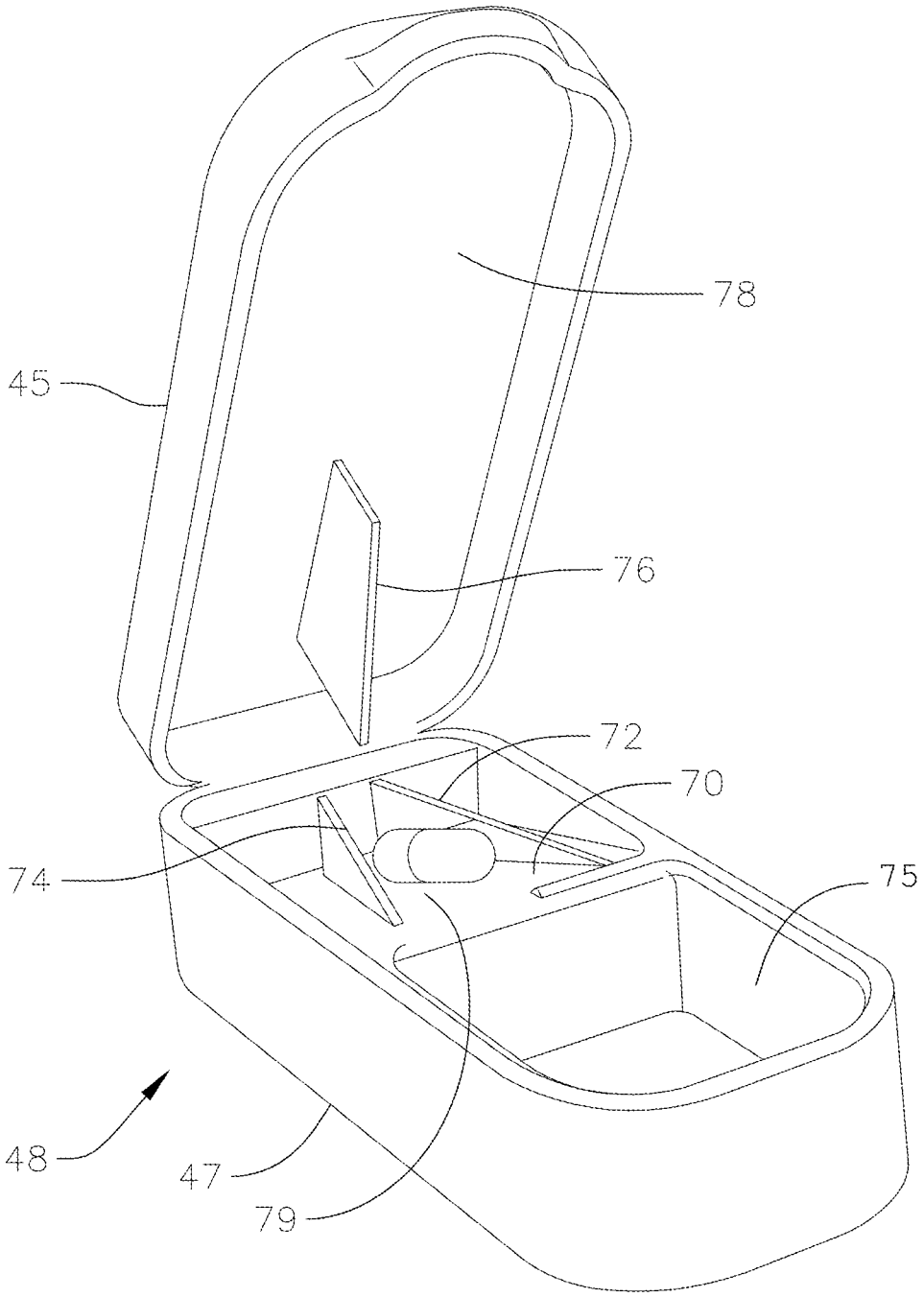
FIG. 6 is a perspective view of an example embodiment pill cutter used in the example embodiment pill organizer depicted in FIG. 1.

In an example embodiment, each pill holder may have multiple pill holding chambers. In an example embodiment shown, there are four pill holding chambers 26 in each pill holder 20, as for example shown in FIGS. 4 and 5. One chamber, for example, may be for morning pills, one may be for noon pills, the other for evening pills and the other one for bedtime pills. The pill holder may include lids 28 for each pill holder chamber or may include a lid for multiple chambers. Each lid may be marked appropriately for the pills it is to receive. The lids maybe hingeably coupled to the housing. In an example embodiment each lid may also include a projection 30 extending from an inner surface of the lid at a location opposite the location where the lid is hinged to the housing. In an example embodiment, the projection 30 frictionally engages an inner surface of its corresponding chamber to snap lock the lid closed over its corresponding chamber.

The housing compartments and the pill holders are designed such that pushing the pill holder into a compartment will cause the pill holder to be engaged by friction by its corresponding compartment. For example, each compartment may include at least a ramp proximate its rear end. In one example embodiment, two ramps 32 are provided extending from an inner surface of the upper wall, as for example shown in FIG. 5. The ramps increase in height in a direction toward the rear of the compartment. In this regard, the pill holders engage the ramp and are frictionally held in place. In another example embodiment, side pads 34 may also be included at a rear of the compartment extending from opposite compartment walls that may also engage the pill holders to provide additional frictional support.

In an example embodiment, the portion 24 of the lower wall extending beyond the upper wall may include a lip 36 extending from an end thereof and spaced apart from the peripheral wall 21 defining an external compartment 37. In an example embodiment the housing is rectangular. The lip includes a first portion 38 parallel to, and spaced apart from, a portion 40 of the peripheral wall 21 defining the external compartment 37 for receiving a pill cutter 48 or any of the pill holders 20. A second portion 42 of the lip extends from the first portion to the peripheral wall. Parallel grooves 44*a*, 44*b* are formed along the portion 40 and an inner surface of the first portion 38 of the lip, respectively. These grooves define a guide for receiving corresponding ribs formed on the pill cutter 48. In another example embodiment, the ribs may be formed in the portion 40 of the peripheral wall 21 and in the inner surface first portion 38 of the lip and the grooves may be formed on the pill cutter. In this regard the pill cutter ribs may be slid into the corresponding grooves 44*a*, 44*b*, and the pill cutter will be mated to the housing and retained in position on the housing. In an example embodiment, the pill cutter includes an upper portion pivotably hinged to a lower portion 47 and the corresponding ribs (or grooves) are formed on the lower portion. In this regard when the pill cutter is mated to the housing, the upper portion may be pivoted relative to the lower portion to allow a pill to be received in the lower portion and to be cut when the upper portion is pivoted to a closed position relative to the lower portion.

The pill cutter includes a pill receiving section 70. In an example embodiment, the pill receiving section 70 is a sloped channel in that it has two sides 72, 74 defining the channel, which slope toward each other in a direction towards the rear of the pill cutter. A collection bin 74 is formed forward of the slope channel. A cutting blade, as for example, a steel cutting blade 76 extends from the inner surface 78 of the upper portion of the pill cutter. In use, a pill is placed in the slope channel such that its wedged or retained by the sloped side 72, 74. The upper portion of the pill cutter is then close relative to the lower portion causing the blade to extend through a mid-plane of the slope channel and to cut the pill in half. The cut pill halves may then be moved to be collected in the collection bin. In an example embodiment, a floor 79 of the pill receiving section has a floor 79 that slopes downward in a direction toward the rear of the pill receiving section so that the pill to be cut slides against the sides 72, 74.

In a further example embodiment, the upper wall 14 of the housing on its upper surface 49 has a plurality of parallel ribs 50 as well as a lip 52 extending along the perimeter of the upper surface except along the portion 40 of the peripheral wall. The ribs define channels 54 between the ribs and between a rib an adjacent portion of the lip 52. In an example embodiment, the number of channels defined is equivalent to the number of pill holder chambers in each pill holder. In the example embodiment shown, each pill holder includes four chamber. With this embodiment, three parallel ribs 50 are formed defining four channels 54. Moreover, the ribs do not extend along the entire length of the upper surface of the upper wall. Rather, they extend from the portion 40 of the peripheral wall and along more than half of the length of the housing. In this regard, pills may be placed in the portion 60 of the upper surface of the upper wall not including the ribs but surrounded by the lip can be sorted such that an appropriate pill for each daytime, as for example, morning, noon, evening and bedtime may be lined up along a corresponding channel. A pill holder 20 then is placed into the external compartment 37. The lids of the pill holder are raised and by moving or lifting the housing at an angle the pills may slide along their corresponding channels into their corresponding chambers into the pill holder.

In an example embodiment, where the housing is rectangular, the housing may be stored such that it rests on its lower wall or the portions of the peripheral wall forming the rear end of the compartments or the portion opposite the external compartment.

Figure 7:
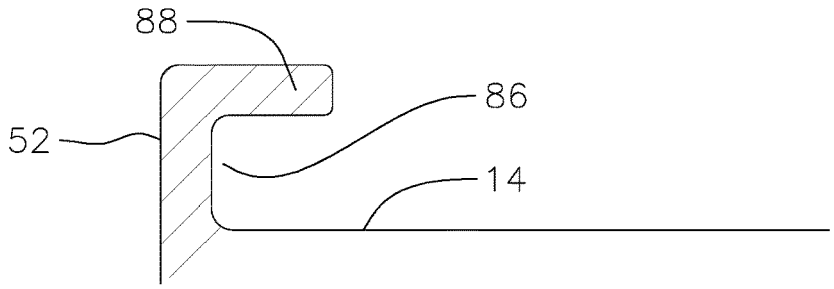
FIG. 7 is a partial cross sectional view of the peripheral lip extending from an upper wall of the example embodiment housing depicted in FIG. 2.
Figure 9:
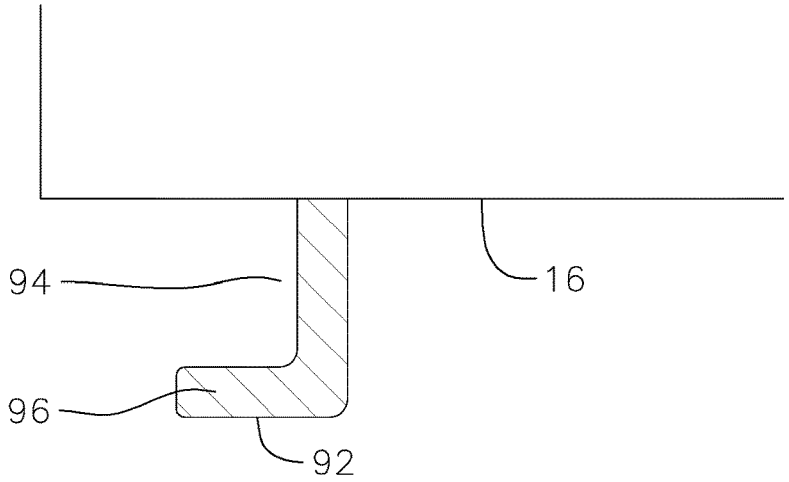
FIG. 9 is a partial cross sectional view of the feet extending from the example embodiment housing shown in FIG. 2.
Figure 10:
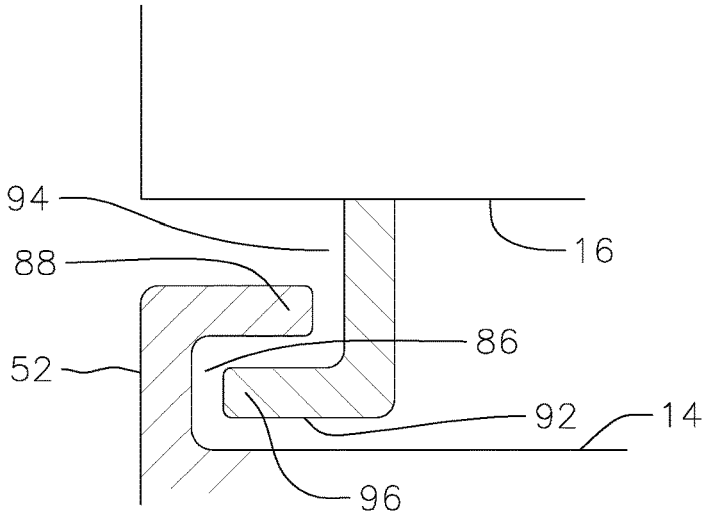
FIG. 10 is a partial cross section view of the example embodiment lip shown in FIG. 1 engaging an example embodiment foot of a different housing.
Figure 8:
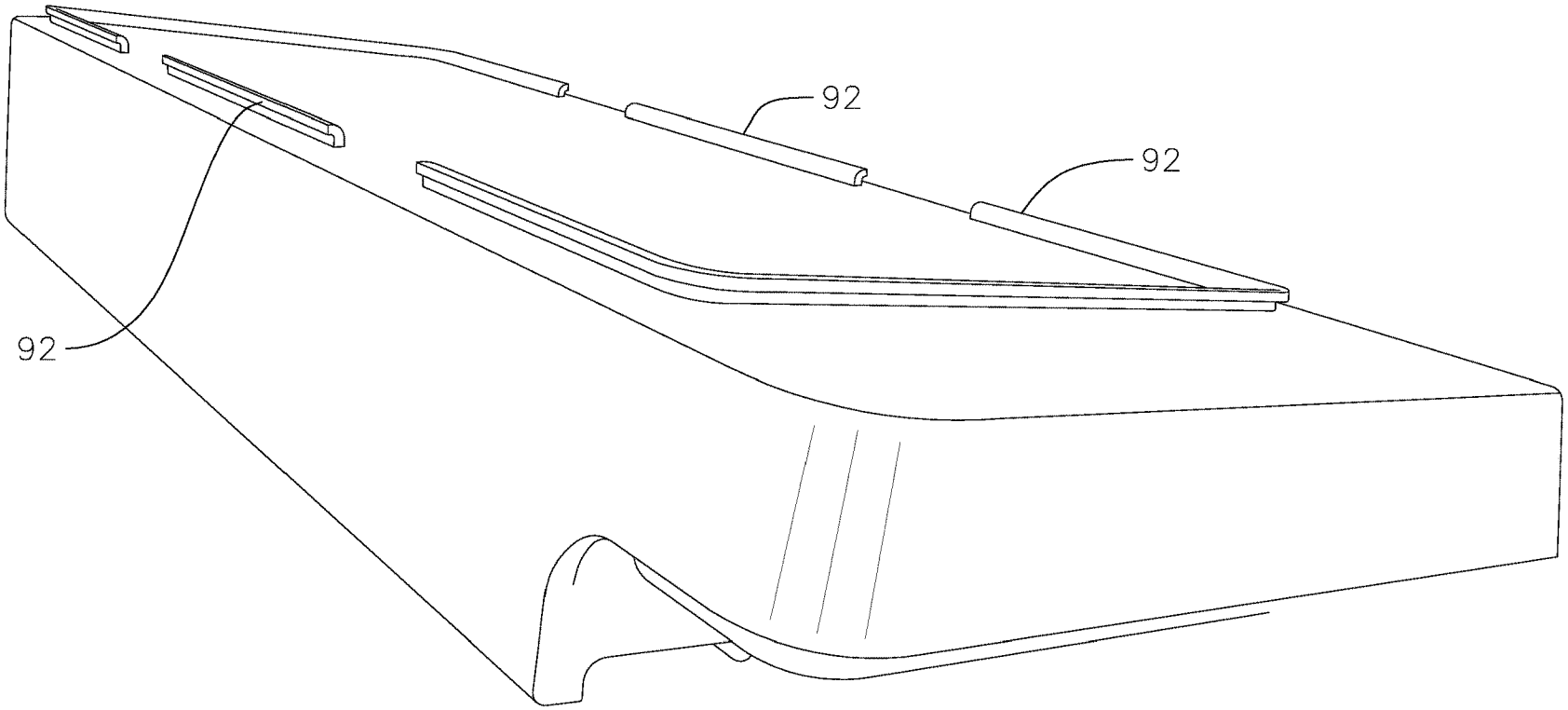
FIG. 8 is a bottom perspective view of the example embodiment housing shown in FIG. 2.

In the example embodiment where the housing is generally rectangular in shape, the lip 52 extends upward from the upper wall along a first or a front side of the housing through which the compartments are formed defining a first lip portion 80. The lip also extends along an end of the housing opposite the peripheral portion 40 defining a second portion 82 and has a third portion 84 opposite the first portion at the rear of the housing defining a third portion 84. The lip begins and ends at the peripheral portion 40. In this regard, the lip has a first portion 80, a third portion 84 spaced apart from the first portion which is interconnected by a second portion 82. One or more channels 86 are defined along the first and third portions of the lip, as for example shown in FIGS. 1, 2 and 7. These portions are defined by an overhang 88 extending from the lip, as for examples shown in FIG. 7. In an example embodiment, where multiple channels are formed on each of the first and third portions of the lip, they're formed along the same length on each portion and are equally spaced apart, as for example shown in FIGS. 1 and 2. In an example embodiment, each lip channel is spaced apart by a distance 90 from an adjacent channel along the first and third portions of the lip. Feet 92 extend downward from the lower wall of the housing, as for example shown in FIGS. 8 and 9. In an example embodiment, the length of each foot 92 is less than the distance 90 between adjacent lip channels. The feet also form channels, as for example shown in FIG. 9. The feet 92 also define an inner channel 94 defined by projection portion 96. In an example embodiment, the housings are stackable such that the feet may be slid within the distance 90 between adjacent channels of the lip formed on the upper wall and then slid such that the channel 86 interlocks with the channel 94, as for example shown in FIG. 10 and one housing locks against the other. In an example embodiment, to unlock, one housing may be pushed relative to the other housing to release the feet channels from the lip channels. Yet, a further example embodiment, the lip does not include the channels 86 nor do the feet include the channels 94. Rather, the housing still remains stackable with the feet of one housing received within the lip 52 of the other housing.

The shape of the pill holder does not have to be rectangular or cubical as shown in the example embodiment disclosed herein. In another example embodiment, the pill holder may be oval in cross section. The housing compartments may be accordingly designed such that they will hold the pill holders in position.

While example embodiments have been described herein, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention.

What is claimed is:

1. A pill organizer comprising:

a housing comprising, a plurality of internal compartments, wherein each internal compartment is adjacent to another internal compartment and an external compartment;

at least one pill holder for being received into one of said plurality of compartments, and into said external compartment said at least one pill holder comprising a plurality of chambers; and a plurality of spaced apart ribs extending from an upper surface of the housing sequentially across each of said plurality of internal compartments and extending toward said external compartment, said plurality of ribs being spaced apart from a lip extending from said upper surface, said plurality of ribs being one less than said plurality of chambers; said plurality of ribs defining a plurality of channels on the upper surface of the housing, said plurality of channels being equal in number to said plurality of chambers, wherein when a pill holder of said at least one pill holder is received into said external compartment, each of the plurality of chambers is aligned with a corresponding channel of said plurality of channels, wherein a pill positioned on a channel can be guided by such channel to its corresponding chamber.

2. The pill organizer of claim 1, further comprising a pill cutter receivable in said external compartment.

3. The pill organizer of claim 2, wherein the pill cutter comprises one of a projection or depression and wherein the external compartment comprises the other of a projection or depression, wherein the projection is received in the depression for mating the pill cutter to the external compartment.

4. The pill organizer of claim 3, wherein the pill cutter is capable of cutting pills while mated to the external compartment.

5. The pill organizer of claim 1, wherein one of said at least one pill holder is receivable in said external compartment.

6. The pill organizer of claim 1, wherein the ribs extend to a first end of said housing but not to a second end opposite the first end.

7. The pill organizer of claim 1, wherein the lip extending from the upper surface is configured to receive at least a foot extending from a lower surface of another pill organizer for stacking said another pill organizer on said pill organizer.

8. The pill organizer of claim 1 wherein said plurality of ribs do not extend across all of said plurality of internal compartments.

9. A pill organizer comprising:

a housing comprising, a plurality of internal compartments, and an external compartment;

at least one pill holder for being received into one of said plurality of compartments, said at least one pill holder comprising at least one chamber; and a pill cutter received in said external compartment, wherein pill cutter comprises one of a projection or depression, wherein the external compartment comprises the other of a projection or depression, and wherein the projection is received in the depression for mating the pill cutter to the external compartment.

10. The pill organizer of claim 9, wherein the pill cutter is capable of cutting pills while mated to the external compartment.

11. The pill organizer of claim 9, wherein one of said at least one pill holder is receivable in said external compartment when said pill cutter is not received in said external compartment.

12. The pill organizer of claim 9, further comprising a lip extending from an upper surface to receive at least a foot extending from a lower surface of another pill organizer for stacking said another pill organizer on said pill organizer.

13. A pill organizer comprising:

a housing comprising, a plurality of internal compartments, each of said plurality of internal compartments each extending along a separate axis, and an external compartment;

at least one pill holder for being received into one of said plurality of compartments along its axis, and in said external compartment, said at least one pill holder comprising a plurality of chambers; and a plurality of channels formed on an upper surface of the housing, each of said plurality of channels extending over and sequentially across each of the axes of said plurality of internal compartments, wherein each of said plurality of channels defines a path extending to said external compartment, wherein when a pill holder of said at least one pill holder is received into said external compartment, each of the plurality of chambers is aligned with a corresponding channel of said plurality of channels, wherein a pill positioned on a channel can be guided by such channel to its corresponding chamber.

14. The pill organizer of claim 13, plurality of channels is equal to said plurality of chambers.

15. The pill organizer of claim 13, further comprising a pill cutter receivable in said external compartment.

16. The pill organizer of claim 15, wherein the pill cutter comprises one of a projection or depression and wherein the external compartment comprises the other of a projection or depression, wherein the projection is received in the depression for mating the pill cutter to the external compartment.

17. The pill organizer of claim 16, wherein the pill cutter is capable of cutting pills while mated to the external compartment.

18. The pill organizer of claim 13, wherein one of said at least one pill holder is receivable in said external compartment along an external compartment axis generally parallel to said axes.

19. The pill organizer of claim 13, further comprising a lip extending from the upper surface to receive at least a foot extending from a lower surface of another pill organizer for stacking said another pill organizer on said pill organizer.

20. A pill organizer comprising:

a housing comprising,
a plurality of internal compartments, and
an external compartment;

at least one pill holder for being received into one of said plurality of compartments, said at least one pill holder comprising at least one chamber;

at least one channel formed on an upper surface of the housing; and a pill cutter receivable in said external compartment, wherein the pill cutter comprises one of a projection or depression, wherein the external compartment comprises the other of a projection of depression, and wherein the projection is received in the depression for mating the pill cutter to the external compartment.

* * * * *